US005626116A

United States Patent [19]

Reedy et al.

[11] Patent Number: 5,626,116

[45] Date of Patent: May 6, 1997

[54] DEDICATED ROCKER LEVER AND CAM ASSEMBLY FOR A COMPRESSION BRAKING SYSTEM

[75] Inventors: Steven W. Reedy, Nashville; David A. Vittorio, Columbus, both of Ind.

[73] Assignee: Cummins Engine Company, Inc., Columbus, Ind.

[21] Appl. No.: 563,333

[22] Filed: Nov. 28, 1995

[51] Int. Cl.[6] ..... F02D 13/04

[52] U.S. Cl. ..... 123/321

[58] Field of Search ..... 123/321, 319, 123/323, 322, 90.16, 90.52

[56] References Cited

U.S. PATENT DOCUMENTS

| | | | |
|---|---|---|---|
| 2,944,565 | 7/1960 | Dahl | 123/321 |
| 3,220,392 | 11/1965 | Cummins | 123/321 |
| 3,332,405 | 7/1967 | Haviland | 123/321 |
| 3,367,312 | 2/1968 | Jonsson | 123/321 |
| 3,921,666 | 11/1975 | Leiber | 137/557 |
| 4,033,304 | 7/1977 | Luria | 123/321 |
| 4,153,016 | 5/1979 | Hausknecht . | |
| 4,251,051 | 2/1981 | Quenneville et al. | 251/129 |
| 4,460,015 | 7/1984 | Burt et al. | 137/625.5 |
| 4,475,500 | 10/1984 | Bostelman | 123/321 |
| 4,572,114 | 2/1986 | Stickler . | |
| 4,592,319 | 6/1986 | Meistrick | 123/321 |
| 4,844,119 | 7/1989 | Martinic | 137/596.17 |
| 4,898,206 | 2/1990 | Meistrick et al. | 137/512.3 |
| 4,996,957 | 3/1991 | Meistrick | 123/321 |
| 5,146,890 | 9/1992 | Gobert et al. | 123/321 |
| 5,273,013 | 12/1993 | Kubis et al. | 123/321 |
| 5,379,737 | 1/1995 | Hu | 123/322 |
| 5,386,809 | 2/1995 | Reedy et al. | 123/320 |
| 5,404,851 | 4/1995 | Neitz et al. | 123/321 |
| 5,406,918 | 4/1995 | Joko et al. | 123/321 |
| 5,462,025 | 10/1995 | Israel et al. | 123/321 |
| 5,485,819 | 1/1996 | Joko et al. | 123/321 |

FOREIGN PATENT DOCUMENTS

| | | | |
|---|---|---|---|
| 1250612 | 10/1971 | United Kingdom | 123/321 |
| 1279977 | 6/1972 | United Kingdom | 123/321 |

*Primary Examiner*—Raymond A. Nelli

*Attorney, Agent, or Firm*—Sixbey, Friedman, Leedom & Ferguson; Charles M. Leedom, Jr.; Tim L. Brackett, Jr.

[57] ABSTRACT

A dedicated compression braking system is provided having at least one engine piston reciprocally mounted within a cylinder for cyclical successive compression and expansion strokes and at least one exhaust valve operable to open in a variable timed relationship with an engine piston compression stroke when the engine is operated in a compression braking mode. The braking system includes an independent exhaust valve actuator assembly, including a braking mode rocker lever and a cam lobe for imparting reciprocable movement to the exhaust valve when the engine is operated in the braking mode. The second exhaust valve actuator assembly includes a braking fluid circuit formed in the braking mode rocker lever and a braking fluid valve and three-way solenoid valve mounted on the braking mode rocker lever for controlling the flow of braking fluid in the braking mode rocker lever during compression braking. The dedicated braking system minimizes the size and weight of the engine and also permits maximum freedom in designing and controlling the operation of the braking system independent of other engine components to maximize the efficiency of compression braking.

23 Claims, 7 Drawing Sheets

BRAKE ON

BRAKE FILL

BRAKE OFF

DEDICATED ROCKER LEVER AND CAM ASSEMBLY FOR A COMPRESSION BRAKING SYSTEM

TECHNICAL FIELD

This invention relates to valve control systems for selectively operating an internal combustion engine in either a power mode or a bring mode, i.e. compression braking. More specifically, this invention relates to a simple, effective compression braking system capable of minimizing the size and weight of the associated engine.

BACKGROUND OF THE INVENTION

For many internal combustion engine applications, such as for powering heavy trucks, it is desirable to operate the engine in a braking mode. This approach involves convening the engine into a compressor by cutting off the fuel flow and opening the exhaust valve for each cylinder near the end of the compression stroke.

An early technique for accomplishing the braking effect is disclosed in U.S. Pat. No. 3,220,392 to Cummins, wherein a slave hydraulic piston located over an exhaust valve opens the exhaust valve near the end of the compression stroke of an engine piston with which the exhaust valve is associated. To place the engine into braking mode, three-way solenoids are energized which cause pressurized lubricating oil to flow through a control valve, creating a hydraulic link between a master piston and a slave piston. The master piston is displaced inward by an engine element (such as a fuel injector actuating mechanism) periodically in timed relationship with the compression stroke of the engine which in turn actuates a slave piston through hydraulic force to open the exhaust valves. The compression brake system as originally disclosed in the '392 patent has evolved in many aspects, including improvements on the control valves (see U.S. Pat. Nos. 5,386,809 to Reedy et al. and 4,996,957 to Meistrick) and the piston actuation assembly (see U.S. Pat. No. 4,475,500 to Bostelman). A typical modern compression braking system found in the prior art is shown in FIG. 8, where the exhaust valves are normally operated during the engine's power mode by an exhaust rocker lever. To operate the engine in a braking mode, a control valve separates the braking system into a high pressure circuit and a low pressure circuit using a check valve which prevents flow of high pressure fluid back into the low pressure supply circuit, thereby allowing the formation of a hydraulic link in the high pressure circuit. A three-way solenoid valve, positioned upstream of the control valve, controls the flow of low pressure fluid to the control valve, and thus, controls the beginning and end of the braking mode.

Various problems have been discovered with conventional compression braking systems. First, an unnecessarily long inherent time delay exists between the actuation of the three-way solenoid valve and the onset of the braking mode. This time delay is in part due to the positioning of the solenoid valve a spaced distance from the control valve creating longer than desired fluid passages and thus response time. Also, unnecessarily long fluid passages between the master and slave pistons, that is, the high pressure circuit, disadvantageously increases the compressed fluid volume and thus the response time. In addition, in conventional compression braking systems, the braking system is a bolt-on accessory that fits above the overhead. In such systems, in order to provide space for mounting the braking system, a spacer is positioned between the cylinder head and the valve cover which is bolted to the spacer. This arrangement adds unnecessary height, weight, and costs to the engine. Many of the above-noted problems result from viewing the braking systems as an accessory to the engine rather than as part of the engine itself.

One possible solution is to integrate components of the braking system with the rest of the engine components. One attempt at integrating parts of the compression braking system is found in U.S. Pat. No. 3,367,312 to Jonsson, which discloses an engine braking system including a rocker arm having a plunger, or slave piston, positioned in a cylinder integrally formed in one end of the rocker arm wherein the plunger can be locked in an outer position by hydraulic pressure to permit braking system operation. Jonsson also discloses a spring for biasing the plunger outward from the cylinder into continuous contact with the exhaust valve to permit the cam-actuated rocker lever to operate the exhaust valve in both the power and braking modes. In addition, a control valve is used to control the flow of pressurized fluid to the rocker arm cylinder so as to permit selective switching between braking operation and normal power operation. However, the control valve unit is positioned separately from the rocker arm assembly, resulting in unnecessarily long fluid delivery passages and a longer response time. This also leads to an unnecessarily large amount of oil that must be compressed before activation of the braking system can occur, resulting in less control over the timing of the compression braking. Furthermore, the control valve is used to control the flow of fluid to a predetermined set of cylinders in the engine thereby undesirably preventing individual engine cylinders or different groups of engine cylinders from being selectively operated in the braking mode. Moreover, the control valve is a manually operated rotary type valve requiring actuation by the driver often resulting in unreliable and inefficient braking operation. Also, rotary valves are subject to undesirable fluid leakage between the rotary valve member and its associated cylindrical bore. The Jonsson braking system also relies on a single cam lobe and rocker arm assembly to move the rocker arms during both normal power and braking operations. However, this arrangement disadvantageously restricts the system's ability to provide exhaust valve operation which is independent from normal valve operation as determined by the associated normal cam profile.

U.S. Pat. No. 3,332,405 to Haviland discloses a compression braking system wherein a control valve unit, for enabling the formation of a hydraulic link, is mounted in a cavity formed in a rocker arm that operates the exhaust valves during the braking mode. Separate cam lobes are used for normal power operation and braking operation. However, a single rocker arm is used to actuate the exhaust valves during both normal and braking modes possibly causing the braking cam lobe profile design, and therefore the braking system operation, to be at least partially dependent on, or influenced by, the design of the cam lobe used for operating the exhaust valve during normal engine operation. In addition, Haviland appears to use a single solenoid for controlling compression braking for all of the cylinders, which permits either none or all of the cylinders to be used for compression braking at any one point, and therefore permits only one level of compression braking power. This restriction results in very little freedom in the operation of the compression braking system. Furthermore, the reference discloses a solenoid valve unit, for controlling the flow of fluid to the control valve, which is housed separately from the control valve unit and the rocker lever, resulting in the need for extra dedicated space in the engine; thus adding to the size and weight of the engine. In addition, the control valve as disclosed in Haviland, and conventional control valves generally, use one or more springs to bias the control valve element. However, these springs are subject to repeated reciprocal motion and excessive stress causing spring failure and thus significant reliability problems, resulting in malfunctioning of the control valve and the compression braking system.

U.S. Pat. No. 4,251,051 to Quenneville discloses a solenoid valve assembly having an inlet communicating with a supply of fluid, and one or more outlet passages communicating with respective loads requiring intermittent fluid supply and a drain passage. A respective ball valve is positioned between the inlet and each outlet and spring biased to block flow between the supply and outlet passage while opening the drain passage. An armature and pin are actuated to move the ball valve so to connect the supply to the outlet, and close the drain passage. However, when the valve assembly in the actuated position permits supply flow to the outlet passage, it does not prevent the return flow of fluid from the outlet passage into the supply passage and therefore could not permit the formation of a hydraulic link between different pressurized circuits as required by a control valve during compression braking system operation.

U.S. Pat. No. 3,921,666 to Leiber discloses a solenoid-operated valve assembly having first and second closure members and a spring positioned therebetween for biasing the members toward respective closed positions blocking fluid flow through respective fluid passages. A solenoid device operates the valve such that when the solenoid is not energized, fluid flows between a first and second connection, while a third connection is closed off by the second closure member. When the solenoid is slightly energized, the first closure member cuts off the communication between the first and second connection, while the second closure member keeps the third connection closed. A higher energization of the solenoid forces the second closure member to open, creating a path for fluid between the second and third connections. However, during higher energization of the valve permitting flow between a supply and load, the second closure member is not operable to block return flow from the load. As a result, this valve does not provide for a integral check valve for allowing fluid to enter a hydraulic circuit without allowing fluid to flow in the opposite direction; that is, from the hydraulic circuit to the supply. Therefore, this valve assembly could not be used in a braking system to create a high pressure hydraulic link between an exhaust valve and a cam lobe while permitting intermittent filling of the high pressure circuit forming the link. In addition, the intermediate stage of slightly energizing the solenoid to achieve the desired flow patterns as discussed above is incompatible with the flow characteristics desired in a compression braking system.

In addition, U.S. Pat. Nos. 2,944,565 to Dahl, 4,460,015 to Burt et al. and 4,844,119 to Martinic disclose other three-way structures for controlling fluid flow. However, these valves suffer from the same shortcomings and problems discussed hereinabove with respect to Haviland, Quenneville, and Leiber.

The timing of the opening and closing of the exhaust valves plays a major role in determining the efficiency and effectiveness of the compression braking system. Many conventional braking systems rely on existing engine components to determine the timing of the exhaust valve opening and closing during compression braking. For example, the braking system shown in U.S. Pat. No. 4,592,319 to Meistrick, utilizes a fuel injector actuation mechanism, such as a cam lobe and push rod, that is normally actuated near the end of the compression stroke. However, reliance on existing cam lobes and other actuators used to actuate other engine components severely limits the spectrum of possibilities for timing the operation of the exhaust valve, thereby precluding optimization of the braking system. U.S. Pat. Nos. 4,572,114 to Sickler and 4,898,206 to Meistrick et al. disclose similar compression braking systems suffering from the same disadvantages as the system disclosed in the '319 reference.

U.S. Pat. No. 5,146,890 to Gobert et al. discloses a method and device for compression braking wherein a dedicated cam lobe operates an exhaust valve during the braking mode. However, the cam lobe operates a dedicated exhaust valve used only during the braking mode. As a result, this design is unnecessarily expensive due to costs relating to the additional exhaust valve assembly and the redesign of the cylinder head to include the additional exhaust port and exhaust valve access passage. Also, this design undesirably creates additional packaging considerations in positioning the exhaust valve in the cylinder head.

Consequently, there is a need for a simple, compact, yet effective braking system which is capable of minimizing the size and weight of the associated engine while ensuring optimum operation of the compression braking system.

SUMMARY OF THE INVENTION

It is an object of the present invention to overcome the disadvantages of the prior art and to provide a dedicated engine compression braking system for converting an engine into a compressor that is capable of minimizing the size and weight of the associated engine.

It is another object of the present invention to provide a dedicated engine compression braking system whose components are integrated to reduce the size and weight of the engine.

It is a further object of the present invention to provide an engine compression braking system that includes braking components dedicated only to the operation of the exhaust valves so as to permit optimum braking operation.

It is still another object of the present to provide a dedicated engine compression braking system that includes a braking fluid valve integrally formed with each braking mode rocker lever for controlling the flow of fluid in a braking fluid circuit to reduce the size of the engine.

It is yet a further object of the present invention to provide a dedicated engine compression braking system that maximizes the efficiency of the compression braking by minimizing the delay time between actuation of the compression braking system and the actual onset of compression braking.

It is still another object of the present invention to provide a dedicated engine compression braking system that minimizes the delay time between the time that the compression braking system is actuated and the onset of compression braking by minimizing the volume of compressed fluid in the braking circuit.

It is yet a further object of the present invention to provide a dedicated engine compression braking system that minimizes the length of the passages in the high and low pressure circuits of the braking system, eliminates the need for passages connecting the three-way valve and control valve of the braking system, and minimizes the length of the passages between the braking fluid valve and the actuator piston of the braking system.

It is yet another object of the present invention to provide a dedicated engine compression braking system that permits maximum freedom in designing and controlling the operation of the braking system independent of other engine components so as to maximize the efficiency of compression braking.

It is still a further object of the present invention to provide a dedicated engine compression braking system that permits individual engine cylinders or different groups of engine cylinders to be independently and selectively operated in the braking mode to permit a plurality of levels of compression braking power.

It is yet another object of the present invention to provide a dedicated engine compression braking system that selectively engages the compression braking at various points in an engine cycle to maximize the effect of the compression braking without increasing mechanical loading on the engine.

It is still a further object of the present invention to provide a dedicated engine compression braking system that controls the timing of the braking mode operation completely independent of the timing of the power mode operation of the engine.

It is still another object of the present invention to provide a dedicated engine compression braking system that permits controlling the amount of displacement of the exhaust valve during compression braking operation independent of the mount of displacement of the exhaust valve necessary for power mode operation of the engine.

To achieve these objects, and other objects that will become apparent in the following description, a dedicated compression braking system is provided for an internal combustion engine having at least one engine piston reciprocally mounted within a cylinder for cyclical successive compression and expansion strokes and an exhaust valve operable to open near the end of an expansion stroke of the engine piston when the engine is operated in the power mode and operable to open in a variable timed relationship to the engine piston compression stroke when the engine is operated in the braking mode. The braking system includes a first exhaust valve actuator, including a power mode rocker lever and a first cam lobe for imparting reciprocal movement of the exhaust valve when the engine is operated in the power mode. The braking system includes a second exhaust valve actuator assembly, including a braking mode rocker lever and a second cam lobe for imparting reciprocable movement to the exhaust valve when the engine is operated in the braking mode. The second exhaust valve actuator assembly includes a braking fluid circuit formed in the braking mode rocker lever and a braking fluid valve mounted on the braking mode rocker lever. The braking fluid circuit includes a low pressure circuit for delivering low pressure fluid to the braking fluid valve and a high pressure circuit for receiving low pressure fluid from the low pressure circuit. The braking fluid valve controls the flow of braking fluid between the low pressure circuit and the high pressure circuit of the braking fluid circuit. The braking mode rocker lever includes a first end positioned adjacent the second cam lobe and a second end positioned adjacent the exhaust valve. The high pressure circuit may include a cavity formed in the first end of the braking mode rocker arm, and the second exhaust valve actuator assembly includes an actuator piston slidably mounted in the cavity and a coil spring mounted in a central bore in the cavity for biasing the actuator piston into the cavity to create a spaced distance between the actuator piston and the exhaust valve during operation of the engine in the power mode. The braking fluid valve may include a three-way solenoid valve having a first position corresponding to the power mode of the engine in which fluid flow from the low pressure circuit to the high pressure circuit is blocked and the high pressure circuit is connected to a drain circuit and a second position corresponding to the braking mode of the engine in which low pressure fluid may flow from the low pressure circuit to the high pressure circuit. The braking fluid valve may also include a first check valve for preventing the flow of fluid from the high pressure circuit to the low pressure circuit. In addition, the braking fluid valve may include a second check valve for allowing the flow of fluid from the high pressure circuit to the drain circuit when the three-way solenoid control valve is in its first position and prevents flow of fluid from the high pressure circuit to the drain circuit when the three-way solenoid control valve is in the second position. The braking fluid valve includes a compression spring positioned between the first and second check valves, wherein the compression spring biases the first check valve to prevent the flow of fluid from the high pressure circuit to the drain circuit when the three-way solenoid valve is in its second position. The braking fluid valve operates to commence the opening of the exhaust valve during the compression stroke of the engine piston such that the exhaust valve reaches its peak displacement into the cylinder before the engine piston reaches top dead center.

DETAILED DESCRIPTION OF THE PREFERRED EMBODIMENTS

Figure 1:
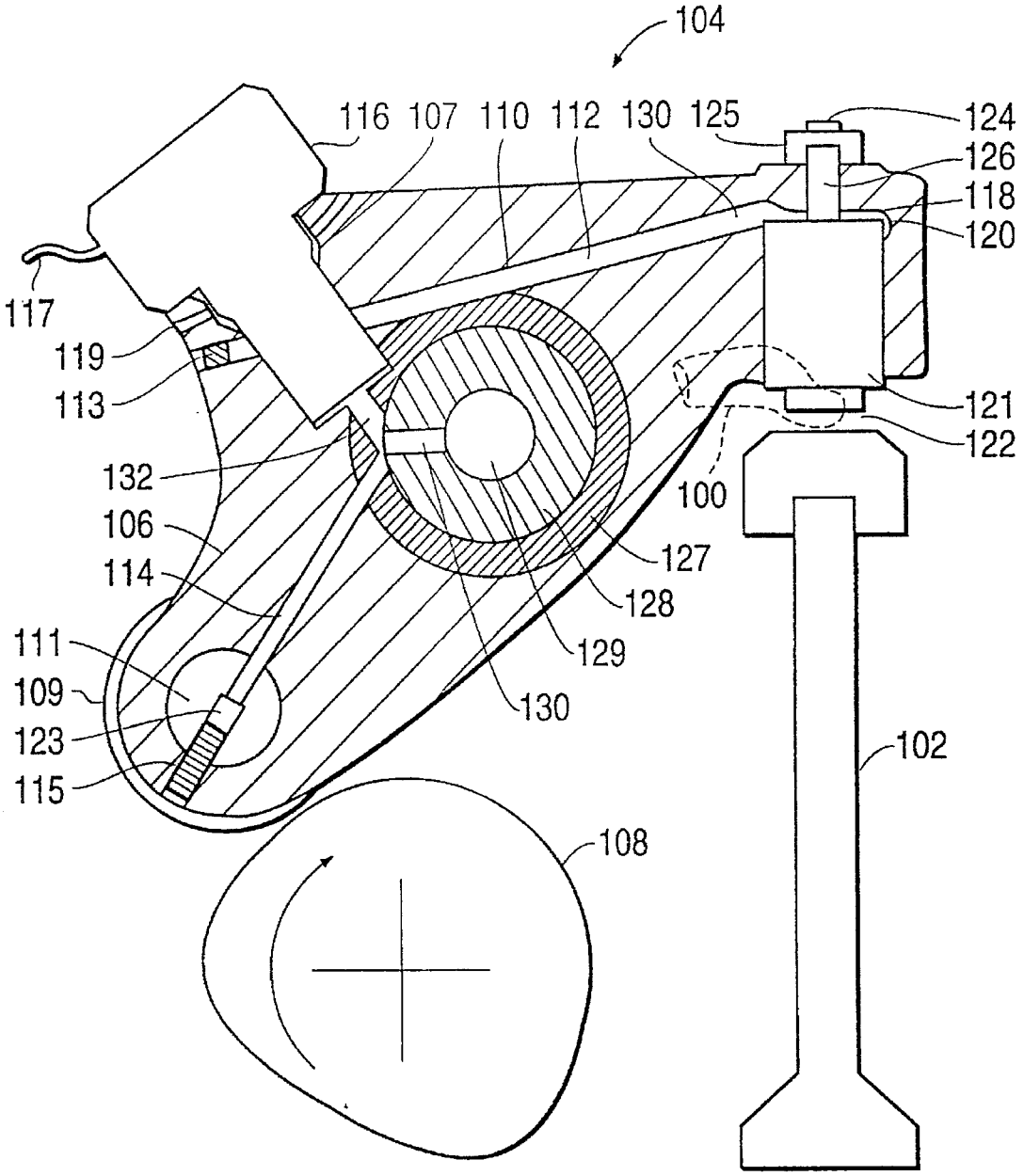
FIG. 1 is a diagrammatic illustration of the dedicated rocker lever/cam lobe structure associated with the integrated compression braking system of the present invention.

Referring to FIG. 1, there is shown a dedicated compression braking system of the present invention for operating an internal combustion engine as a compressor when the engine is placed in a braking mode. In particular, FIG. 1 discloses a power mode rocker lever 100 of a power mode exhaust valve actuator assembly that operates to reciprocally displace an exhaust valve 102 when the engine is operated in a normal power mode. In the power mode, the power mode rocker lever 100 displaces the exhaust valve into an engine cylinder (not shown) during, for instance, the exhaust cycle of a four-cycle operation of the engine in order to exhaust combusted gas from the engine cylinder. When it becomes necessary to operate the engine in the braking mode, a braking mode exhaust valve actuating assembly, generally shown as 104, controls the compression braking. The braking mode exhaust valve actuator assembly 104 includes a braking mode rocker lever 106 and an associated braking mode cam lobe 108 for each engine cylinder. The braking mode rocker lever 106 and the braking mode cam lobe 108 work together to displace the exhaust valve 102 when the engine is operated in the braking mode. Braking mode exhaust valve actuator assembly 104 also includes a braking fluid circuit 110 formed within the rocker lever 106, an actuator piston 120 mounted on braking mode rocker lever 106, and a braking fluid valve 116 for controlling the flow of braking fluid through braking fluid circuit 110 so as to selectively place the assembly 104 in a braking mode.

The braking circuit 110 includes a high pressure circuit 112, a low pressure circuit 114, and a drain circuit 119. The high pressure circuit 112 and low pressure circuit 114 are formed by drilling passages into braking mode rocker lever 106, and then using plugs 113, 115 to seal the high pressure and low pressure circuits, respectively. Braking fluid valve 116 is mounted in a rocker lever bore 107 formed in the braking mode rocker lever 106. Alternatively, instead of plug 113, braking fluid valve 116 could be sized and oriented in bore 107 so that the body of valve 116 fluidically seals the open end of the drilling forming high pressure circuit 112. Braking fluid valve 116 operates to control the flow of braking fluid between the high pressure circuit 112, the low pressure circuit 114, and the drain circuit 119. Braking fluid valve 116 is controlled by an engine control module (not shown) which provides signals to braking fluid valve 116 through wiring 117. Also, it should be noted that drain circuit 119 could be formed by a passage formed integrally in braking fluid valve 116.

Actuator piston 120 is slidably mounted in an actuator piston bore 118 formed in one end of braking mode rocker lever 106. The actuator piston 120, having an actuator piston body 121, is operated to control an amount of spaced distance, or lash, 122 present between braking mode rocker lever 106 and exhaust valve 102. The actuator piston 120 is connected to the braking mode rocker lever 106 by a screw or bolt 124 which extends through a threaded hole 126 formed in braking mode rocker lever 106 for engagement by a jam nut 125. Braking mode rocker lever 106 further includes a braking mode rocker lever shaft 128, affixed to an engine overhead (not shown), on which the braking mode rocker lever 106 pivots in response to the lift profile of the braking mode cam lobe 108. A bearing in the form of a cylindrical bushing 127 is positioned around shaft 128 and rigidly connected to rocker lever 106 so as to permit smooth pivotal rotation on shaft 128. It should be noted that FIG. 1 shows an arbitrary lift profile of the braking mode cam lobe 108, and any lift profile as may be necessary for a particular application can be used instead. Braking mode rocker lever 106 also includes a roller 109 mounted on a roller pin 111 positioned in aperatures formed in one end of braking mode rocker lever 106 opposite position bore 118. Roller 109 contacts the outer surface of cam lobe 108 and rotates as the braking mode cam lobe 108 rotates.

Low pressure circuit 114 includes a central supply bore 129, a radial supply passage 130 formed in lever shaft 128, and a feed passage 132 formed in rocker lever 106. Passage 132 communicates with radial supply passage 130 to supply low pressure fluid from central bore 129 to braking fluid valve 116. Low pressure circuit 114 also includes a lubricating delivery passage 123 for delivering braking fluid from radial passage 130 to roller pin 111 for lubrication purposes.

Figure 2:
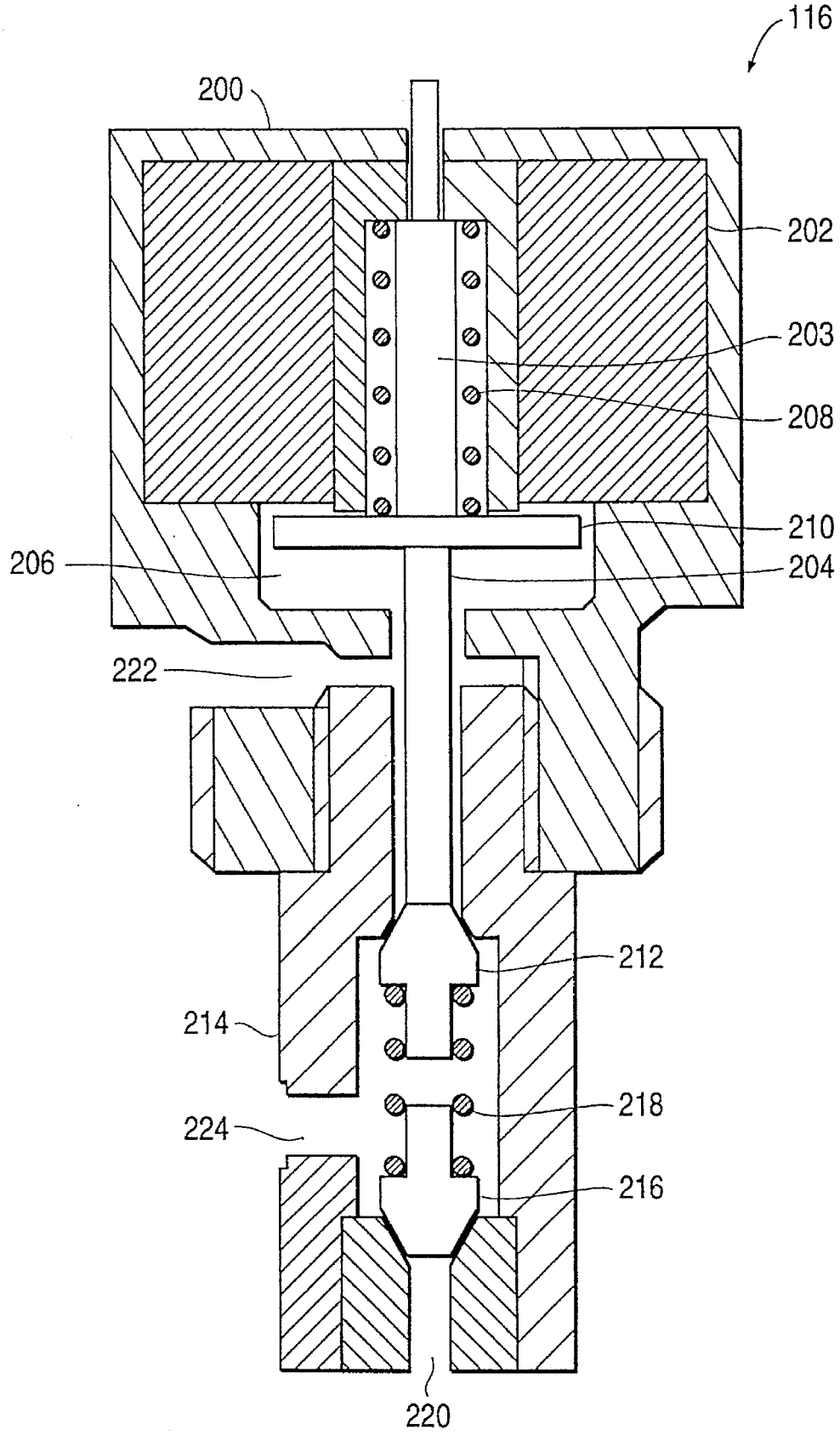
FIG. 2 is a cross-sectional view of a braking fluid valve of the dedicated compression braking system in accordance with the present invention.
Figure 3C:
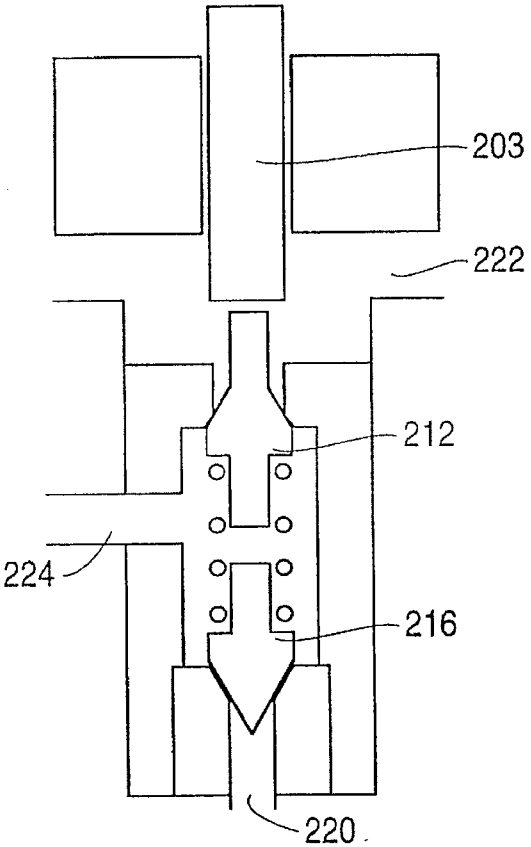
FIGS. 3*a*, 3*b* & 3*c* are cross-sectional views of the braking fluid valve during power and braking modes of engine operation.
Figure 3B:
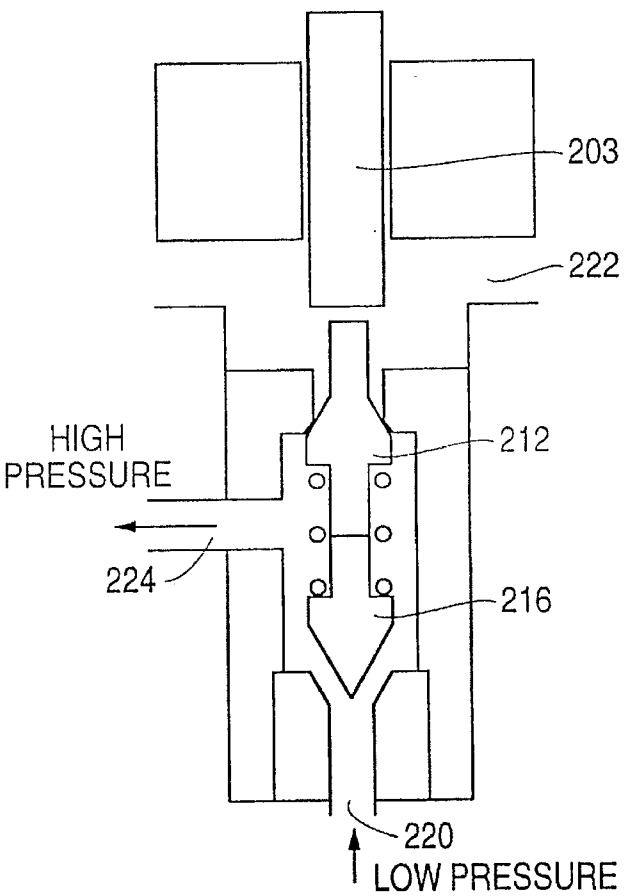
Figure 3A:
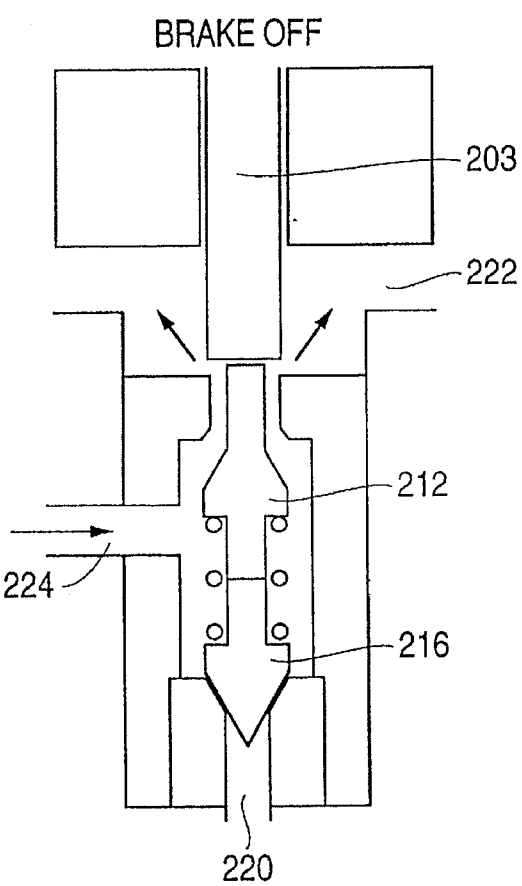

Referring now to FIG. 2, the braking fluid valve 116 will be described in greater detail. This braking fluid valve is the subject of a co-pending application, U.S. application Ser. No. 275,118, entitled *Solenoid Valve for Compression-Type Engine Retarder*, filed Jul. 14, 1994, the contents of which are incorporated herein by reference. Generally, braking fluid valve 116 as shown is a compact, integrated three-way solenoid valve and control valve which functions to selectively control the beginning and end of the braking mode while also permitting both the quick, effective creation of a high pressure link in high pressure circuit 112 and sufficient filling of high pressure circuit 112 as necessary. Braking fluid valve 116 includes housing 200, solenoid coils 202, and an armature 203 including an armature disc 210 disposed in a bore region 206 formed in housing 200. Positioned about armature 203 is an armature spring 208 that abuts against armature disc 210 so as to bias the armature 210 away from the solenoid coils 202, in a downward direction as shown in FIG. 2. A drain check valve 212 is positioned below armature 203 in a valve cavity 211 formed in a valve body 214 threadingly connected to housing 200. Drain check valve 212 includes a valve stem 204 which may be formed separately from, or integrally with, armature disc 210. Positioned below drain check valve 212 is an inlet check valve 216 with a compression spring 218 positioned therebetween for biasing the check valves apart. Valve body 214 includes an annular drain valve seat 213 positioned for sealing abutment by drain check valve 212 and an annular inlet valve seat 215 positioned for sealing abutment by inlet check valve 216. Braking fluid valve 116 also includes passages 220, 222, and 224 to provide flow of fluid to the necessary circuits. In the present invention, inlet passage 220 communicates with low pressure circuit 114, drain passage 222 leads to the drain circuit 119, and outlet passage 224 leads to the high pressure circuit 112. The operation of braking fluid valve 116 is shown in FIG. 3. In the "Brake Off" position in FIG. 3*a*, when solenoid coils 202 are not energized, armature disc 210 is biased downward by spring 218 so as to seat against valve stem 204 of drain check valve 212. The bias force of spring 208 is large enough to overcome the bias force of compression spring 218, thus causing drain check valve 212 to contact inlet check valve 216 to close off inlet passage 220 thereby blocking the flow of fluid from low pressure circuit 114 to high pressure circuit 112. In addition, passages 222 and 224 are in fluidic connection via cavity 211 such that high pressure circuit 112 is connected to the drain circuit 119. Next, in the "Brake Fill" and "Brake On" positions, shown in FIGS. 3*b* and 3*c* respectively, when the solenoid coils 202 become energized, armature disc 210 is attracted to the coils 202 and is moved upwardly against the bias of armature spring 208 so as to lift armature disc 210 away from valve stem 204 of drain check valve 212. The bias force of compression spring 218 causes drain check valve 212 to seat against drain valve seat 213 thus blocking fluid flow to drain passage 222. In addition, with sufficient fluid pressure in low pressure circuit 114 to overcome the bias force of compression spring 218, a fluidic connection is made between low pressure circuit 114 and high pressure circuit 112 allowing braking fluid to flow from low pressure circuit to high pressure circuit. When the high pressure circuit 112 becomes completely full of braking fluid, corresponding to the "Brake On" position of FIG. 3*c*, with no more fluid able to flow to the high pressure circuit, fluid flow between the high pressure and low pressure circuits is blocked by inlet check valve 216, which seals the high pressure circuit.

This compact structure of the braking fluid valve 116 allows it to be easily mounted onto the braking mode rocker lever 106 shown in FIG. 1, thereby reducing the size of the engine by avoiding separate solenoid and control valves mounted in other areas of the engine, such as in an additional spacer block positioned in the engine overhead.

Figure 4:
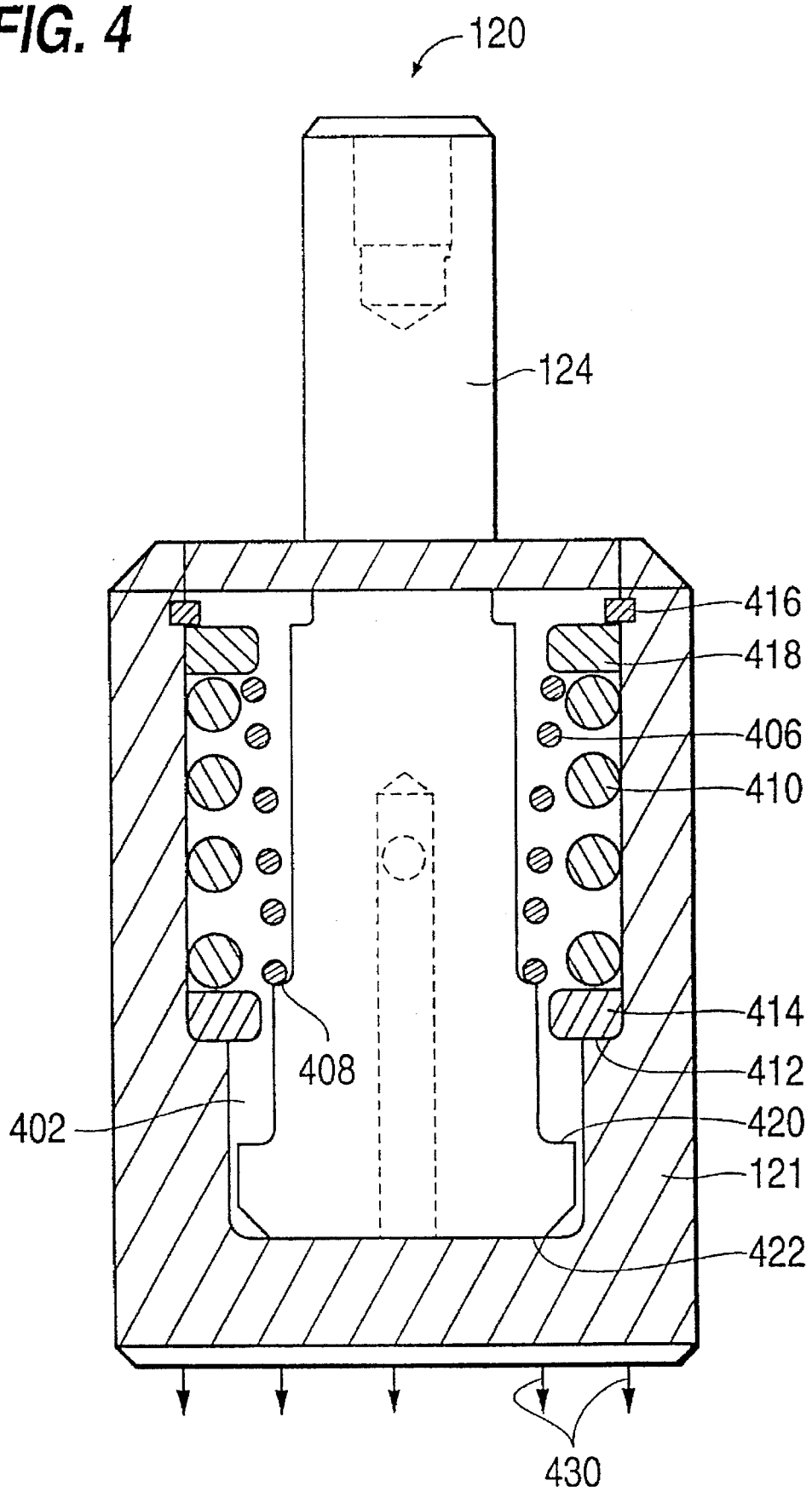
FIG. 4 is a cross-sectional view of an actuator piston of the dedicated compression braking system in accordance with the present invention.

Referring now to FIG. 4, the actuator piston 120 will be described in greater detail. The actuator piston 120 includes an actuator piston body 121 having a central bore 402 within which adjusting screw 124 extends. Adjusting screw 124 is adjustedly secured to rocker lever 106 by nut 125 (FIG. 1) so as to permit the spaced distance 122 (shown in FIG. 1) between the bottom of actuator piston 120 and the exhaust valve 102 to be adjusted. Actuator piston body 121 is slidably positioned in actuator piston bore 118 so as to move relative to adjusting screw 124 in an axial manner. An inner compression spring 406, positioned in central bore 402 about the adjusting screw 124, biases actuator piston body 121 upward into actuator piston bore 118 of FIG. 1. One end of inner compression spring 406 acts against an annular upper flange 408 formed on fixed adjusting screw 124 while the opposite end abuts an upper spacer 418 held in place by a retaining ring 416 securely positioned in a groove formed in piston body 121. Thus, spring 406 forces actuator piston body 121 upwardly as shown in FIG. 4. An outer compression spring 410, having a larger spring force than inner compression spring 406, is also provided in central bore 402 about inner compression spring 406. One end of outer compression spring 410 abuts upper spacer 418 while the opposite end abuts a lower spacer 414 positioned against an actuator flange portion 412 formed on actuator piston body 121. Furthermore, adjusting screw 124 includes a lower flange 420 that abuts spacer 414 to limit the outward movement of the actuator piston body 121, as will become apparent from the following discussion.

In the operation of actuator piston 120, the actuator piston body 121 is normally biased upward into actuator piston bore 118 such that a bottom end 422 of adjusting screw 124 contacts actuator piston body 121. When braking fluid enters the upper section of piston bore 118, it acts on exposed surfaces of the actuator piston body 121 and if the fluid pressure is great enough to overcome the bias force of inner compression spring 406, the actuator piston body 121 is forced downward in an axial direction as indicated generally by arrows 430. The outward travel of the actuator piston body 121 is limited by lower spacer 414 contacting the lower flange 420 of adjusting screw 124. At this point, any further movement would require that the braking fluid overcome the bias force of the outer compression spring 410. However, the outer compression spring 410 has a spring force large enough to prevent spring compression despite the force of the braking fluid while cushioning the impact of spacer 414 against flange 420.

The operation of the braking mode exhaust valve actuating assembly 104 will now be described. When the engine is operated in the power mode, the braking fluid valve 116 is in its "Brake Off" position (FIG. 3*a*) in which braking fluid flows between the high pressure circuit 112 and the drain circuit 119. The actuator piston body 121 of actuator piston 120 is biased upward into actuator piston bore 118, and insufficient oil pressure is present in cavity 130 to overcome the bias of inner compression spring 406 (FIG. 4). This creates a spaced distance 122 large enough such that even with the pivoting of braking mode rocker lever 106 due to the lift profile of braking mode cam lobe 108, the actuator piston 120 does not contact exhaust valve 102. The adjusting screw 124 may be adjusted accordingly to ensure that a large enough spaced distance 122 is present. Therefore, the braking mode exhaust valve actuating assembly 104 does not open the exhaust valve 102 and thus, does not affect the normal power mode operation of the engine.

When the engine is placed into the braking mode, the engine control module (not shown) provides the necessary signals to the braking fluid valve 116 through wiring 117 to energize solenoid coils 202 thus attracting armature disc 210. As disc 210 moves upward, drain check valve 212 seats against drain valve seat 213 blocking fluid flow between passages 222 and 224, thereby cutting off fluid flow between the high pressure circuit 112 and the drain circuit 119. In addition, fluid pressure in low pressure circuit 114 is enough to cause inlet check valve 216 to lift up so as to fluidically connect low pressure circuit 114 and high pressure circuit 112. Braking fluid flows through high pressure circuit 112 into the upper portion of actuation piston bore 118 and into central bore 402 of actuator piston 120. The pressure of the braking fluid causes actuator piston body 121 to be slidably displaced downward, represented by arrows 430 in FIG. 4, out of actuator piston bore 118 thus decreasing the spaced distance 122 between actuator piston 120 and exhaust valve 102. The spaced distance 122 is decreased enough such that the lift profile of the braking mode cam lobe 108 causes actuator piston 120 to contact the exhaust valve 102 and, thus, causes the exhaust valve to be displaced a predetermined amount into the engine cylinder at selected points in the engine cycle as determined by the profile of braking mode cam lobe 108.

In the present system, it has been found advantageous to open the exhaust valve before the end of the compression stroke such that the peak displacement of the exhaust valve into the cylinder occurs before top dead center of the engine piston. This particular timing cycle increases the amount of retarding work done for each cycle. In addition, the amount of displacement of the exhaust valve into the cylinder is only that amount necessary for compression braking, which is approximately 0.090–0.100 inch, but which may vary depending on the particular engine application. The preferred manner of controlling the operation of the present invention relative to engine operation is disclosed in detail in co-pending U.S. patent application by Vittorio entitled *Improved Engine Retarder Cycle* and filed the same day as the present application.

When compression braking is no longer needed, and the engine is to be placed back into the power mode, the engine control module relays the necessary signals to the braking fluid valve 116, solenoid coils 202 are deenergized, and armature 203 is biased back to its original position by armature spring 208. As a result, armature disc 210 pushes valve stem 204 and drain check valve 212 downwardly against the bias of compression spring 218 until valve 212 abuts inlet check valve 216 forcing valve 216 against its seat 215, thus blocking fluidic connection between inlet passage 220 and outlet passage 224. In addition, outlet passage 224 is now in fluidic connection with drain passage 222, so that high pressure circuit 112 can vent braking fluid to drain circuit 119. This venting lowers the braking fluid pressure in piston bore 118, which allows inner compression spring 406 to bias actuator piston body 121 upward into actuator piston bore 118. Therefore, the spaced distance 122 is once again increased to the point where the pivoting movement of braking mode rocker lever 106 in response to the lift profile of braking mode cam lobe 108 is insufficient to make actuator piston 120 contact the exhaust valve 102.

Figure 5:
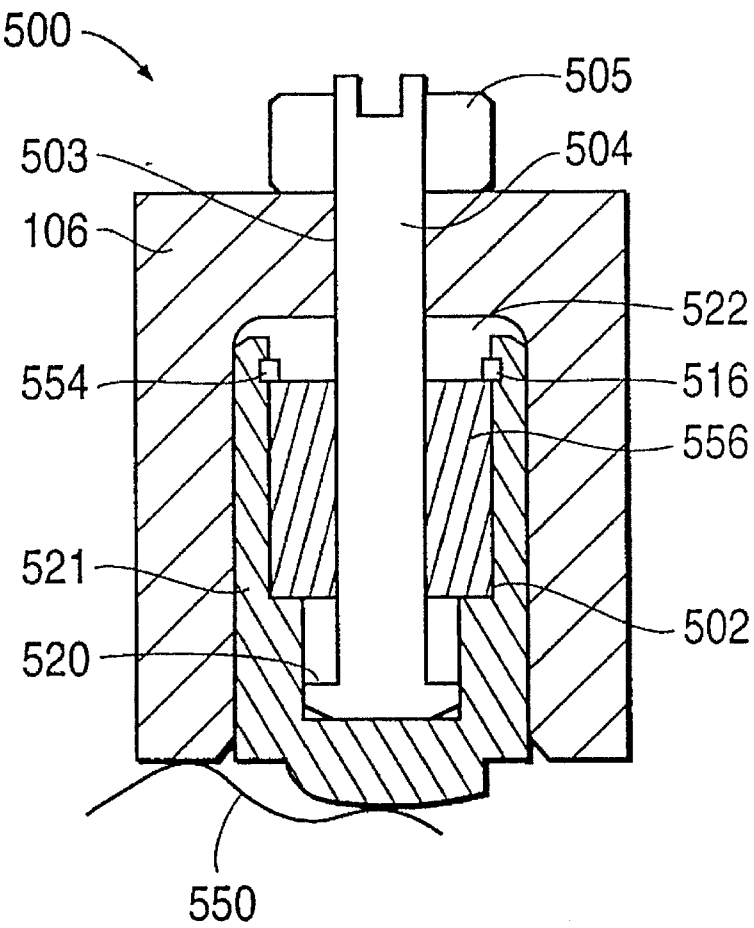

Referring now to FIG. 5, a second embodiment of the actuator piston, now labelled as 500, is shown which is similar in some respects to the actuator piston 120 of the first embodiment, shown in FIG. 4 in that an actuator piston body 521 is slidably positioned in an actuator piston bore 522 formed in braking mode rocker lever 106. An adjusting screw 504 having a lower flange 520 is positioned in a central bore 502 and extends through a threaded hole 503 for secure engagement by a jam nut 505. However, in the present embodiment, a solid spacer 556 positioned in central bore 502 is used for abutting lower flange 520 to stop the outward movement of piston body 521 in lieu of outer spring 410 and spacers 414,418. A retaining ring 516 is positioned in a groove portion 554 formed in body 521 to secure spacer 556 in place against a lower piston flange 552. Also, an external leaf spring 550 attached to the rocker lever 106 is used to bias piston body 521 into piston bore 522, in place of spring 406 of the embodiment of FIG. 4.

In operation, when high pressure braking fluid enters the bore 522, fluid pressure forces actuator piston body 521 and spacer 556 downwardly as shown in FIG. 5 toward the exhaust valve (not shown) similar to the first embodiment, and against the bias force of external leaf spring 550. After a predetermined distance, the bottom of solid spacer 556 contacts lower flange 520 of the adjusting screw 504. The solid spacer 556 has a structure that does not contract due to the force of the increased pressure braking fluid, so that the movement of actuator piston body 521 is limited.

Figure 6:
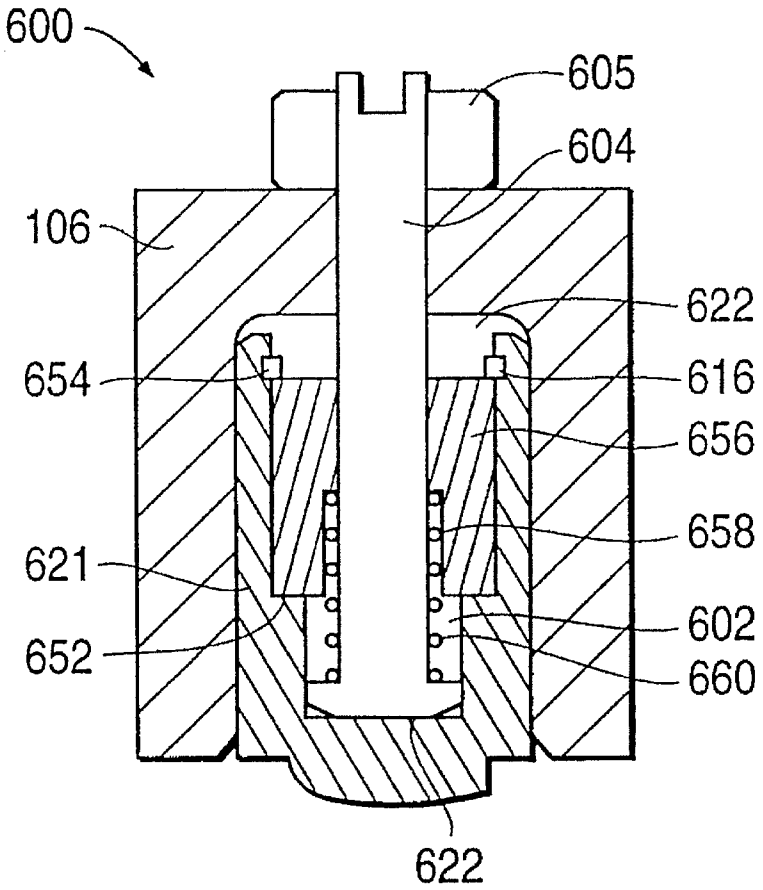
FIGS. 5 and 6 are cross-sectional views of second and third embodiments, respectively, of the actuator piston of the present invention.

Referring now to FIG. 6, a third embodiment of the actuator piston, now labelled as 600, is illustrated which is similar to the actuator piston 500 shown in FIG. 5 and includes an actuator piston body 621, adjusting screw 604 having a lower flange 620 positioned in central bore 602, and a retaining ring 616 positioned in notch 654 of piston body 621 for securing a solid spacer 656 in place against a lower piston flange 652. The solid spacer 656 differs from solid spacer 556 of the second embodiment in that the solid spacer 656 of the present embodiment includes a central recess 658 for receiving compression spring 660. The other end of spring 660 abuts against lower flange 620 of adjusting screw 604 so as to bias piston body 621 into bore 622.

Figure 7:
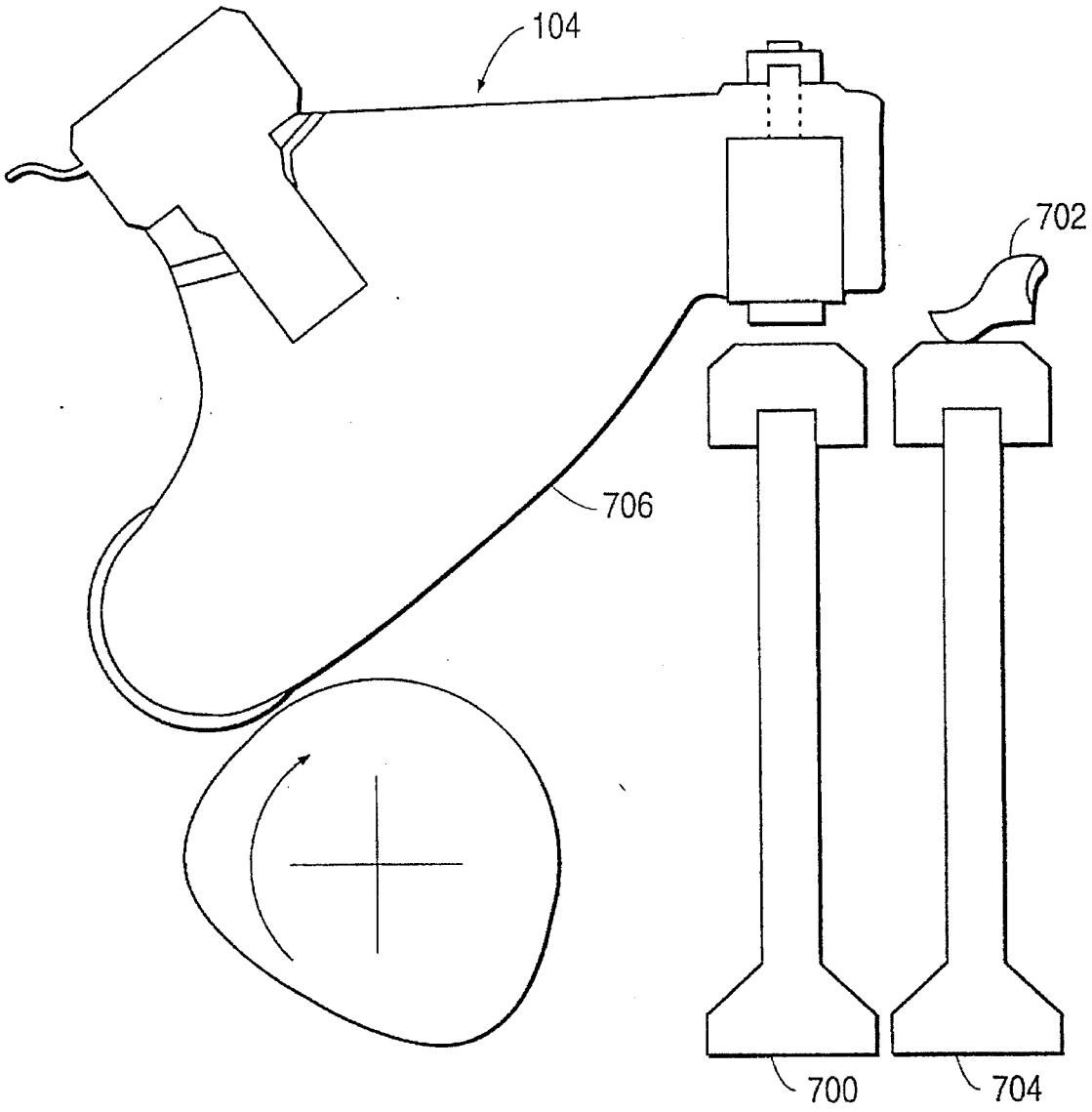
FIG. 7 is a general schematic of a second embodiment of the dedicated compression braking system in accordance with the present invention.

Referring now to FIG. 7, a second embodiment of the power mode and braking mode exhaust valve actuator assemblies will be described. The braking mode exhaust valve actuator assembly 104 is the same as shown in FIG. 1 and described in detail above. This embodiment is very similar to the first embodiment, the only difference being that the braking mode exhaust valve actuator assembly 104 acts on separate exhaust valves than the power mode exhaust valve actuator assembly used for normal power mode operation. As shown in FIG. 7, the power mode exhaust valve actuator assembly, for which a power mode rocker lever 702 is shown, operates on power mode exhaust valves 704 but not on braking mode exhaust valves 700. The braking mode exhaust valve actuator assembly 104, for which a braking mode rocker lever 706 is shown, operates on braking mode exhaust valves 700 but not on power mode exhaust valves 704. Except for controlling the displacement of different exhaust valves, the operation of the compression braking system in the power and braking modes is the same as that of the first embodiment.

Figure 8:
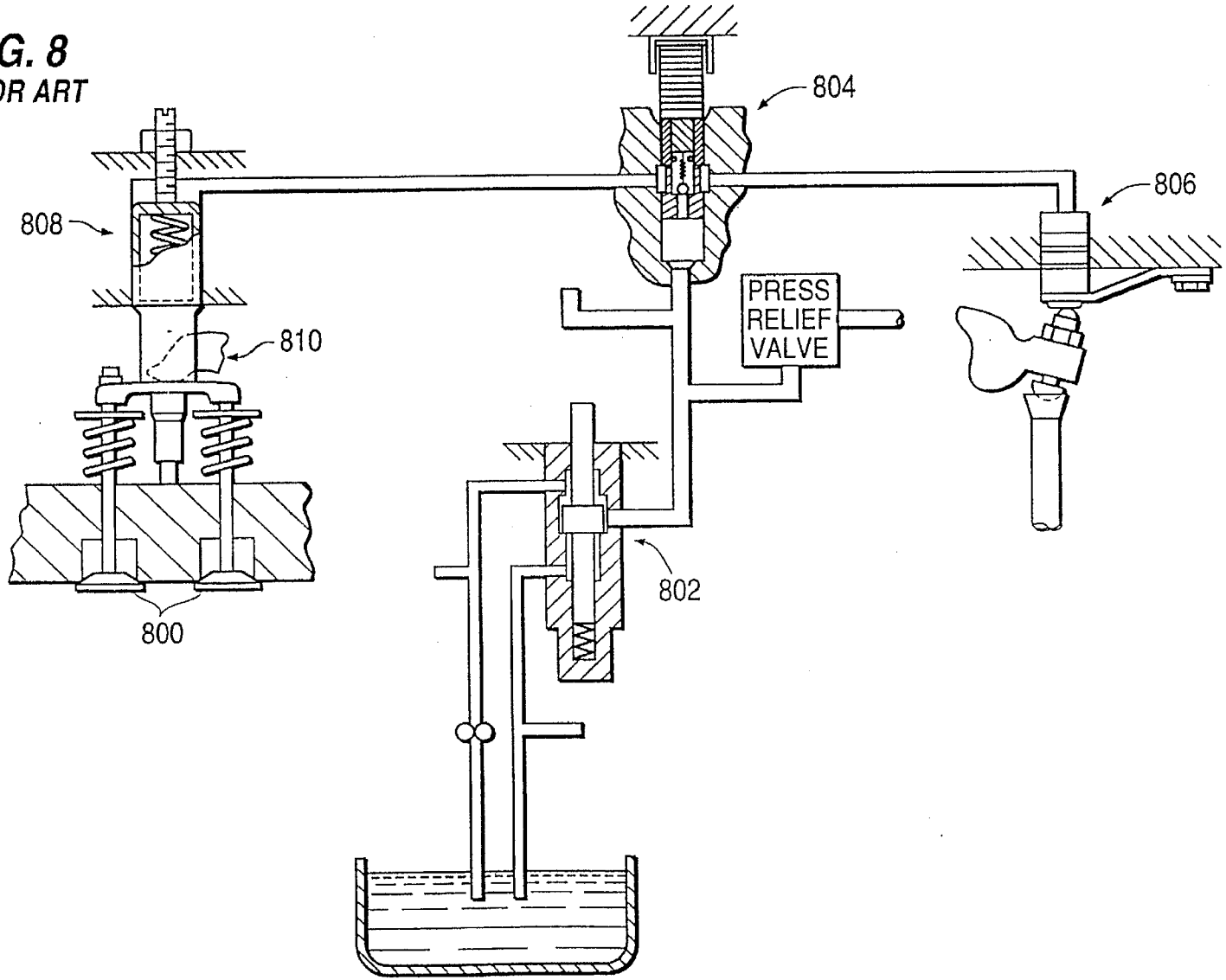
FIG. 8 PRIOR ART
FIG. 8 is a diagrammatic view of a conventional compression braking system for a fuel injected internal combustion engine.

The compression braking system of the present invention has many important advantages over the prior art. One important advantage is the reduction of the size and weight of the engine, which results in significant cost savings. In conventional arrangements (FIG. 8), the three-way solenoid valve 802, control valve 804, and fluid pressurizing means 806 are all positioned apart from one another and further are positioned separate from the rocker lever 810 that operates exhaust valves 800. As a result, a spacer plate, positioned between the cylinder head and the valve cover, is needed to provide the necessary space for the compression braking system. By contrast, in the present invention, by having the three-way valve and control valve integrally formed as a braking fluid valve 116, and having the braking fluid valve mounted in a bore 107 of braking mode rocker lever 106, the need for the spacer is eliminated. In addition, there is no need for a separate fluid pressurizing means because its function is incorporated into the present braking fluid valve 116. Furthermore, the rocker levers used in the compression braking system will weigh less than using a traditional, complicated engine brake housing that includes a spacer plate. All of these improvements reduce the size and weight, and therefore cost, of the engine.

Another important advantage of the present invention relates to the effectiveness of the compression braking, particularly with respect to the response time for activation of the compression braking system and specifically the time delay between the transmission of the necessary signals from the engine control module to the actual onset of compression braking. In the conventional arrangement of FIG. 8, with the three-way solenoid valve 802 separated from control valve 804, and these structures positioned a significant distance from actuator slave piston 808, there exists unnecessarily long fluid passages between the master and slave pistons. This results in an inherently long time delay between the actuation of three-way valve 802 and the onset of compression braking, thereby reducing the efficiency of the compression braking. By contrast, with the present invention, the three-way solenoid valve and the control valve are integrally formed in braking fluid valve 116 so as to eliminate the need for passages between the three-way solenoid valve and the control valve, which inherently reduces the time delay between the actuation of solenoid coils 202 and the creation of a high pressure link in high pressure circuit 112 as determined in part by the movement of drain check valve 212 (FIG. 2) into a blocking position to cutoff braking fluid from flowing between high pressure circuit 112 and drain circuit 119 while permitting flow between high pressure circuit 112 and low pressure circuit 114. In addition, shorter passages are present between the braking fluid valve 116 and actuator piston 120 to further reduce the delay until the actual onset of compression braking. By lowering the inherent delay between the actuation of the compression braking system and the onset of compression braking, the effectiveness of the compression braking system is greatly increased.

By providing a dedicated rocker lever and cam lobe structure, the present invention also permits maximum freedom in operating the compression braking system independent of other engine component operations thereby permitting for optimal timing and exhaust valve displacement to be used in operation of the compression braking. For one, the dedicated rocker lever and cam lobe structure has the ability to provide different levels of compression braking power at any given moment. In conventional arrangements, such as that of U.S. Pat. No. 3,367,312 to Jonsson, a single control valve is used to control the flow of fluid to the entire set of cylinders. Only one level of compression braking power is permitted, which results in minimal control over how much compression braking power is used compared to how much may actually be necessary in a particular situation. With the present invention, with each cylinder having its own dedicated rocker lever and cam lobe, anywhere from one cylinder to all of the engine cylinders can be used for compression braking at any given time, thereby allowing numerous levels of compression braking power. This permits utilizing precisely the amount of compression braking power as may be necessary in a given situation, thereby further increasing the efficiency of the compression braking system.

In addition to providing numerous levels of compression braking power, the present dedicated rocker lever and cam lobe structure allows the timing and displacement of the exhaust valves to be controlled independent of the operation of other engine components such as cam-operated injectors. In conventional arrangements, such as that of U.S. Pat. No. 3,332,405 to Haviland, a single rocker arm is used to actuate the exhaust valves during both the normal power mode and the braking mode of the engine. In such arrangements, the braking cam profile design is forced to take into account the design necessary for operating the exhaust valve during power mode operation. Moreover, many conventional braking systems operate the exhaust valve during compression braking by using the same cam lobe that is used to operate the fuel injector during the normal power mode thereby severely restricting the optimum design of the braking system. This limits the possible spectrum of timing for opening the exhaust valve during braking mode operation because including lifts in the profile design for braking mode operation may cause an inadvertent opening of the exhaust valve during the power mode operation of the engine. Conventional structures rely on opening the exhaust valve when an engine piston reaches TDC in a compression stroke during the braking mode, because this is also when the injector plunger begins its injection stroke in the normal power mode. With the present arrangement, a separate braking mode cam lobe 108 permits complete freedom in controlling the opening and closing of the exhaust valve. In particular, in the timing of the present compression braking system, the exhaust valve is opened before the end of the compression stroke such that the peak displacement of the exhaust valve into the cylinder occurs before TDC of the engine piston. This increases the amount of retarding work done for each cycle over conventional designs, which do not have peak displacement of the exhaust valve until after TDC. Furthermore, this increase in retarding work performed before the engine piston reaches TDC is accomplished without having to increase the pressure in the cylinder.

Another advantage to having an independent cam lobe structure is that the peak displacement for the exhaust valve can be controlled independent of the peak displacement of the exhaust valve during power mode operation. The necessary displacement of the exhaust valve is less for compression braking purposes than for power mode operation. While the amount of displacement necessary for power mode operation may be about 0.400 inches for a particular engine, the displacement necessary for braking mode operation would be on the order of only about 0.090–0.100 inches for the same engine. Therefore, in conventional arrangements that utilize the same cam lobe for power mode and braking mode operations, the exhaust valves move well beyond the displacement that is actually necessary in braking mode operation, resulting in the possibility of valve clearance problems. The present arrangement, however, permits opening the exhaust valve to only be opened to the extent necessary, such as 0.090–0.100 inches, which eliminates any possible valve clearance problems.

INDUSTRIAL APPLICABILITY

The dedicated rocker lever and cam assembly of the present invention can be utilized in an internal combustion engine for controlling the movement of any engine member during some specific time period. The dedicated rocker lever and cam assembly is particularly suited for use in compression braking systems for heavy duty vehicles.

We claim:

1. A braking system for an internal combustion engine having at least one engine piston reciprocally mounted within a cylinder for cyclical successive compression and expansion strokes and at least one exhaust valve operable to open near the end of an expansion stroke of the engine piston when the engine is operated in a power mode and operable to open in a variable timed relationship to the engine piston compression stroke when the engine is operated in a braking mode, said braking system comprising:

a first exhaust valve actuating means for imparting reciprocable movement to said at least one exhaust valve when the engine is operated in the power mode, said first exhaust valve actuating means including a power mode rocker lever pivotally mounted adjacent said at least one exhaust valve for opening said at least one exhaust valve when the engine is operated in the power mode and a first cam means for pivoting said power mode rocker lever; and a second exhaust valve actuating means for imparting reciprocable movement to said at least one exhaust valve when the engine is operated in the braking mode, said second exhaust valve actuating means including a braking mode rocker lever pivotally mounted adjacent said at least one exhaust valve for opening said at least one exhaust valve and a second cam means for pivoting said braking mode rocker lever.

2. The braking system of claim 1, wherein said second exhaust valve actuating means includes a braking fluid circuit formed in said braking mode rocker lever and a braking fluid valve means for controlling the flow of braking fluid through said braking fluid circuit.

3. The braking system of claim 2, wherein said braking fluid circuit includes a low pressure circuit for delivering low pressure fluid to said braking fluid valve means and a high pressure circuit for receiving low pressure fluid from said low pressure circuit, said braking fluid valve means operable to control the flow of braking fluid between said low pressure circuit and said high pressure circuit.

4. The braking system of claim 3, wherein said braking fluid valve means is mounted on said braking mode rocker lever.

5. The braking system of claim 4, wherein said second cam means pivots said braking mode rocker lever by applying a braking mode actuating force, a first end of said braking mode rocker lever being positioned adjacent said second cam means, further including an actuator piston bore formed in a second end of said braking mode rocker lever, said second exhaust valve actuating means including an actuator piston slidably mounted in said actuator piston bore and a first biasing means for biasing said actuator piston into said actuator piston bore to create a spaced distance between said actuator piston and said at least one exhaust valve during operation in said power mode.

6. The braking system of claim 5, wherein said actuator piston includes a central bore, said first biasing means including a coil spring positioned in said central bore.

7. The braking system of claim 6, wherein said braking fluid valve means includes a three-way solenoid valve having a first position corresponding to the power mode of the engine in which fluid flow from said low pressure circuit to said high pressure circuit is blocked and said high pressure circuit is connected to a drain circuit and a second position corresponding to the braking mode of the engine in which low pressure fluid may flow from said low pressure circuit to said high pressure circuit.

8. The braking system of claim 7, wherein said braking fluid valve means includes a first check valve for preventing the flow of fluid from said high pressure circuit to said low pressure circuit.

9. The braking system of claim 8, wherein said braking fluid valve means includes a second check valve for permitting the flow of fluid from said high pressure circuit to said drain circuit when said three-way solenoid valve is in said first position and prevents flow of fluid from said high pressure circuit to said drain circuit when said three-way solenoid valve is in said second position.

10. The braking system of claim 9, wherein said braking fluid valve means includes a second biasing means positioned between said first check valve and said second check valve wherein said second biasing means biases said first check valve to prevent the flow of fluid from said high pressure circuit to said drain circuit when said three-way solenoid valve is in said second position.

11. The braking system of claim 2, wherein said braking fluid valve means causes said exhaust valve to begin opening during the compression stroke of the engine piston such that said exhaust valve reaches its peak displacement into the engine cylinder before the engine piston reaches top dead center.

12. In a braking system for an internal combustion engine having at least one engine piston reciprocally mounted within a cylinder for cyclical successive compression and expansion strokes and at least one power mode exhaust valve operable to open near the end of an expansion stroke of the engine piston when the engine is operated in a power mode and at least one braking mode exhaust valve operable to open in a variable timed relationship to the engine piston compression stroke when the engine is operated in a braking mode, said braking system comprising:

a first exhaust valve actuating means for imparting reciprocable movement to said at least one power mode exhaust valve when the engine is operated in the power mode; and a second exhaust valve actuating means for imparting reciprocable movement to said at least one braking mode exhaust valve when the engine is operated in the braking mode, said second exhaust valve actuating means including a braking mode rocker lever pivotally mounted adjacent said at least one braking mode exhaust valve for opening said at least one braking mode exhaust valve, said braking mode rocker lever including a first end for receiving a braking mode actuating force and a second end for delivering said braking mode actuating force to said at least one braking mode exhaust valve.

13. The braking system of claim 12, wherein said first exhaust valve actuating means includes a power mode rocker lever pivotally mounted adjacent said at least one power mode exhaust valve for opening said at least one power mode exhaust valve when the engine is operated in the power mode.

14. The braking system of claim 12, wherein said second exhaust valve actuating means includes a braking fluid circuit formed in said braking mode rocker lever and a braking fluid valve means for controlling the flow of braking fluid through said braking fluid circuit, said braking fluid circuit including a low pressure circuit for delivering low pressure fluid to said braking fluid valve means and a high pressure circuit for receiving low pressure fluid from said low pressure circuit, said braking fluid valve means operable to control the flow of braking fluid between said low pressure circuit and said high pressure circuit.

15. The braking system of claim 14, wherein said braking fluid valve means is mounted on said braking mode rocker lever, said braking fluid valve means including a three-way solenoid valve having a first position corresponding to the power mode of the engine in which fluid flow from said low pressure circuit to said high pressure circuit is blocked and said high pressure circuit is connected to a drain circuit and a second position corresponding to the braking mode of the engine in which low pressure fluid may flow from said low pressure circuit to said high pressure circuit.

16. The braking system of claim 15, wherein said second exhaust valve actuating means includes a second cam means for pivoting said braking mode rocker lever by applying said braking mode actuating force, said first end of said braking mode rocker lever being positioned adjacent said second cam means, further including an actuator piston bore formed in said second end of said braking mode rocker arm, said second exhaust valve actuating means including an actuator piston slidably mounted in said actuator piston bore and having a central bore, and a first biasing means for biasing said actuator piston into said actuator piston bore to create a spaced distance between said actuator piston and said at least one exhaust valve during operation in said power mode, said first biasing means including a coil spring positioned in said central bore.

17. The braking system of claim 18, wherein said braking fluid valve means includes a first check valve for preventing the flow of fluid from said high pressure circuit to said low pressure circuit, a second check valve for permitting the flow of fluid from said high pressure circuit to said drain circuit when said three-way solenoid control valve is in said first position and for preventing flow of fluid from said high pressure circuit to said drain circuit when said three-way solenoid valve is in said second position, and a second biasing means positioned between said first check valve and said second check valve, said second biasing means biases said first check valve to prevent the flow of fluid from said high pressure circuit to said drain circuit when said three-way solenoid valve is in said second position, said second biasing means including a compression spring.

18. The braking system of claim 17, wherein said braking fluid valve means causes said exhaust valve to begin to open during the compression stroke of the engine piston such that said exhaust valve reaches its peak displacement into the engine cylinder before the engine piston reaches top dead center.

19. In a braking system for an internal combustion engine having at least one engine piston reciprocally mounted within a cylinder for cyclical successive compression and expansion strokes and at least one exhaust valve operable to open near the end of an expansion stroke of the engine piston when the engine is operated in a power mode and operable to open in a variable timed relationship to the engine piston compression stroke when the engine is operated in a braking mode, said braking system comprising:

a braking mode rocker lever pivotally mounted adjacent said at least one exhaust valve for opening said exhaust valve when the engine is operated in the braking mode;

a braking fluid circuit formed in said braking mode rocker lever and including a low pressure circuit and a high pressure circuit;

a drain circuit in fluidic communication with said high pressure circuit; and a braking fluid valve means mounted on said braking mode rocker lever for controlling the flow of fluid in said braking fluid circuit, said braking fluid valve means including a three-way valve operable to cause the engine to operate in said braking mode and movable into a first position corresponding to the power mode of the engine in which fluid flow from said low pressure circuit to said high pressure circuit is blocked and said high pressure circuit is connected to a drain circuit and a second position corresponding to the braking mode of the engine in which said drain circuit is blocked and low pressure fluid may flow from said low pressure circuit to said high pressure circuit.

20. The braking system of claim 19, wherein said three way valve is a solenoid-operated valve.

21. The braking system of claim 20, wherein said braking mode rocker arm includes a first end positioned adjacent said second cam means, a second end positioned adjacent said at least one exhaust valve and an actuator piston bore formed in said second end of said braking mode rocker arm, said second exhaust valve actuating means including an actuator piston slidably mounted in said actuator piston bore and having a central bore, and a first biasing means for biasing said actuator piston into said actuator piston bore to create a spaced distance between said actuator piston and said at least one exhaust valve during operation in said power mode, said first biasing means including a coil spring positioned in said central bore.

22. The braking system of claim 21, wherein said braking fluid valve means includes a first check valve for preventing the flow of fluid from said high pressure circuit to said low pressure circuit, a second check valve for allowing the flow of fluid from said high pressure circuit to said drain circuit when said three-way valve is in said first position and for preventing flow of fluid from said high pressure circuit to said drain circuit when said three-way valve is in said second position, and a second biasing means positioned between said first check valve and said second check valve, wherein said second biasing means biases said first check valve to prevent the flow of fluid from said high pressure circuit to said drain circuit when said three-way valve is in said second position.

23. The braking system of claim 19, wherein said braking fluid valve means causes said exhaust valve to begin to open during the compression stroke of the engine piston such that said exhaust valve reaches its peak displacement into said cylinder before the engine piston reaches top dead center.

* * * * *